United States Patent [19]

Instance

[11] Patent Number: 4,801,929

[45] Date of Patent: Jan. 31, 1989

[54] CONTAINER HAVING AUDIBLE CLOSURE REMOVAL SIGNALLING

[76] Inventor: David J. Instance, Guinea Hall, Sellindge, Kent, United Kingdom

[21] Appl. No.: 12,831

[22] Filed: Feb. 10, 1987

[30] Foreign Application Priority Data

Feb. 10, 1986 [GB] United Kingdom ..... 8603201

[51] Int. Cl.[4] ..... G08B 25/02

[52] U.S. Cl. ..... 340/692; 215/201; 340/384 E

[58] Field of Search ..... 340/691, 692, 568, 570, 340/600, 540, 545, 693, 309.15, 309.4, 384 E; 368/10; 604/404; 116/72, 100; 215/201; 200/61.62, 61.81, 61.82; 206/534, 807; 220/DIG. 34; 221/2-8; 222/23, 41, 48; 239/71-74

[56] References Cited

U.S. PATENT DOCUMENTS

| | | | |
|---|---|---|---|
| 4,034,757 | 7/1977 | Glover | 604/404 |
| 4,155,077 | 5/1979 | Rohan et al. | 340/600 |
| 4,223,801 | 9/1980 | Carlson | 221/3 |
| 4,351,999 | 9/1982 | Nagamoto et al. | 340/384 E |
| 4,367,955 | 1/1983 | Ballew | 368/10 |
| 4,400,786 | 8/1983 | Mandel et al. | 340/692 |
| 4,419,016 | 12/1983 | Zoltan | 368/10 |
| 4,535,903 | 8/1985 | Franchi | 206/534 X |
| 4,538,894 | 9/1985 | Shirane | 340/692 |
| 4,641,054 | 2/1987 | Takahata | 340/384 E |
| 4,682,299 | 7/1987 | McIntosh et al. | 340/309.15 X |
| 4,688,023 | 8/1987 | McGill et al. | 340/545 |

FOREIGN PATENT DOCUMENTS

| | | |
|---|---|---|
| 266032 | 2/1927 | United Kingdom . |
| 1561097 | 2/1980 | United Kingdom . |
| 2092991 | 8/1982 | United Kingdom . |
| 2115317 | 9/1983 | United Kingdom . |

*Primary Examiner*—Glen R. Swann, III
*Assistant Examiner*—Thomas J. Mullen, Jr.
*Attorney, Agent, or Firm*—Limbach, Limbach & Sutton

[57] ABSTRACT

A container for a product, the container having means for electronically generating an audible signal relating to the product in the container, which means are activated by a user.

7 Claims, 2 Drawing Sheets

CONTAINER HAVING AUDIBLE CLOSURE REMOVAL SIGNALLING

BACKGROUND TO THE INVENTION

The present invention relates to a container and in particular to a container having means for electronically generating an audible signal relating to a product to be contained in the container.

At present, it is known to label containers with visual information which often a user of the product ignores or does not take full cognizance of. It is particularly important when packaging toxic chemicals or pharmaceuticals, for example, to ensure that the user is made fully aware of the properties of the product.

It is also known to provide containers, such as bottles having removable threaded closures, with a device for visually indicating unauthorised tampering with the product in the container, the tamper-indicating device generally comprising a frangible strip around the closure which is deformed when the container is opened. However, it is sometimes possible to tamper with the container by removing the closure and then to replace the closure without giving any visual indication of tampering to the end user of the product.

British Patent Specification No. 2115317 discloses a container for use in an agricultural spraying system which has a memory device for storing a record of the contents of the container.

British Patent Specification No. 2092991 discloses a pill box which emits signals at predetermined intervals to indicate when a pill should be taken.

British Patent Specification No. 1561097 discloses a suitcase with a theft alarm.

British Patent Specification No. 266032 discloses a stopper for a bottle which has a squeaker which emits a squeak when the stopper is grasped to remove it from the bottle.

U.S. Pat. Specification No. 4223801 discloses a drug dispenser including a timer for indicating when the various drugs which are stored in the dispenser are to be taken.

SUMMARY OF THE INVENTION

The present invention relates to a container which can directly impart audible information to the end user of the product to inform him of the properties of the product or of unauthorised tampering with the container.

The present invention accordingly provides a container for a product, the container having means for electronically generating an audible signal relating to the product in the container, which means are activated by a user.

BRIEF DESCRIPTION OF THE DRAWINGS

An embodiment of the present invention will now be described by way of example only with reference to the accompanying drawings, in which.

DESCRIPTION OF THE PREFERRED EMBODIMENTS

Figure 1:
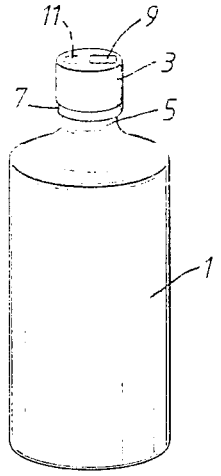
FIG. 1 shows a perspective view of a bottle having a removable cap which incorporates an audible signal generating means in accordance with the present invention.

Referring to FIG. 1, a bottle 1, which is typically of plastics material, is closed by a removable threaded cap 3, which is also typically of plastics material, which is screwed onto the neck 5 of the bottle 1. The cap 3 is provided at its lower circumferential edge with an integral tear-off strip 7 which has inwardly directed lugs (not shown) which cooperate with corresponding outwardly directed lugs (not shown) on the neck 5 so that the cap 3 cannot be removed from the bottle 1 without first tearing-off the tear strip 7 from the cap 3. When the tear-off strip 7 is intact on the bottle 1 this indicates visually that the contents of the bottle 1 have not been tampered with by an unauthorised person subsequently to manufacture.

Such bottles are already known. The present invention modifies such known bottles so that they are able directly to impart electronically generated audible and visual information to the user concerning unauthorised tampering with the bottle cap and concerning other properties or uses of the product in the bottle.

Figure 2:
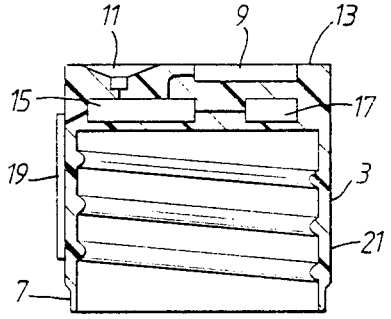
FIG. 2 is a longitudinal section through the removable cap shown in FIG. 1.

In accordance with the invention, and as is shown in FIG. 2 the top surface of the cap 3 is provided with a liquid crystal display unit 9 of any desired size and configuration and also with a speaker 11 for emitting the output from a speech processer which is described in detail below. The speaker 11 may be a piezo electric speaker or a miniaturized moving coil speaker. Desirably, the speaker is incorporated into the cap 3, and the top wall 13 of the cap 3 is configured, in such a way that the top wall 13 acts as a diaphragm for the speaker 11 and thereby amplifies the sounds emitted from the speaker 11. The speaker 11 is protected from damage and foreign matter by the top wall 13 of the cap 3.

Within the body of the cap 3 is located electronic circuitry 15 for operating the speaker 11 and the liquid crystal display unit 9. The circuitry 15 is connected electronically to a power source 17, which may be, for example, a lithium button cell, a solar cell or an electrostatically powered device, and to a trigger device 19 which is located on the outer periphery 21 of the cap 3. The trigger device 19 may be one of a variety of types of sensors depending upon the particular application in which the bottle incorporating the invention is to be utilized. For example, the trigger device 19 may be a heat sensor which senses the heat from a person's fingers; a pressure transducer which detects the pressure applied by a person's fingers; a sound sensor (which may be adapted, for example, to detect a particular password) or a light sensor. Alternatively, the trigger device 19 may be adapted to detect the mechanical twist action of the turning of the cap 3 by a user who is trying to open the bottle 1. This latter type of trigger device 19 could consist, for example, of a pair of electrical contacts which are connected, or disconnected, when the cap 3 is twisted mechanically relative to the bottle 1 when it is attempted to open the bottle 1.

The trigger device 19, electronic circuitry 15, liquid crystal display unit 9 and speaker 11 are arranged so that when the trigger device 19 is activated, in the appropriate manner, a particular message is displayed visually on the liquid crystal display unit 9 and either the same or a different audible message is emitted from the speaker 11.

Figure 3:
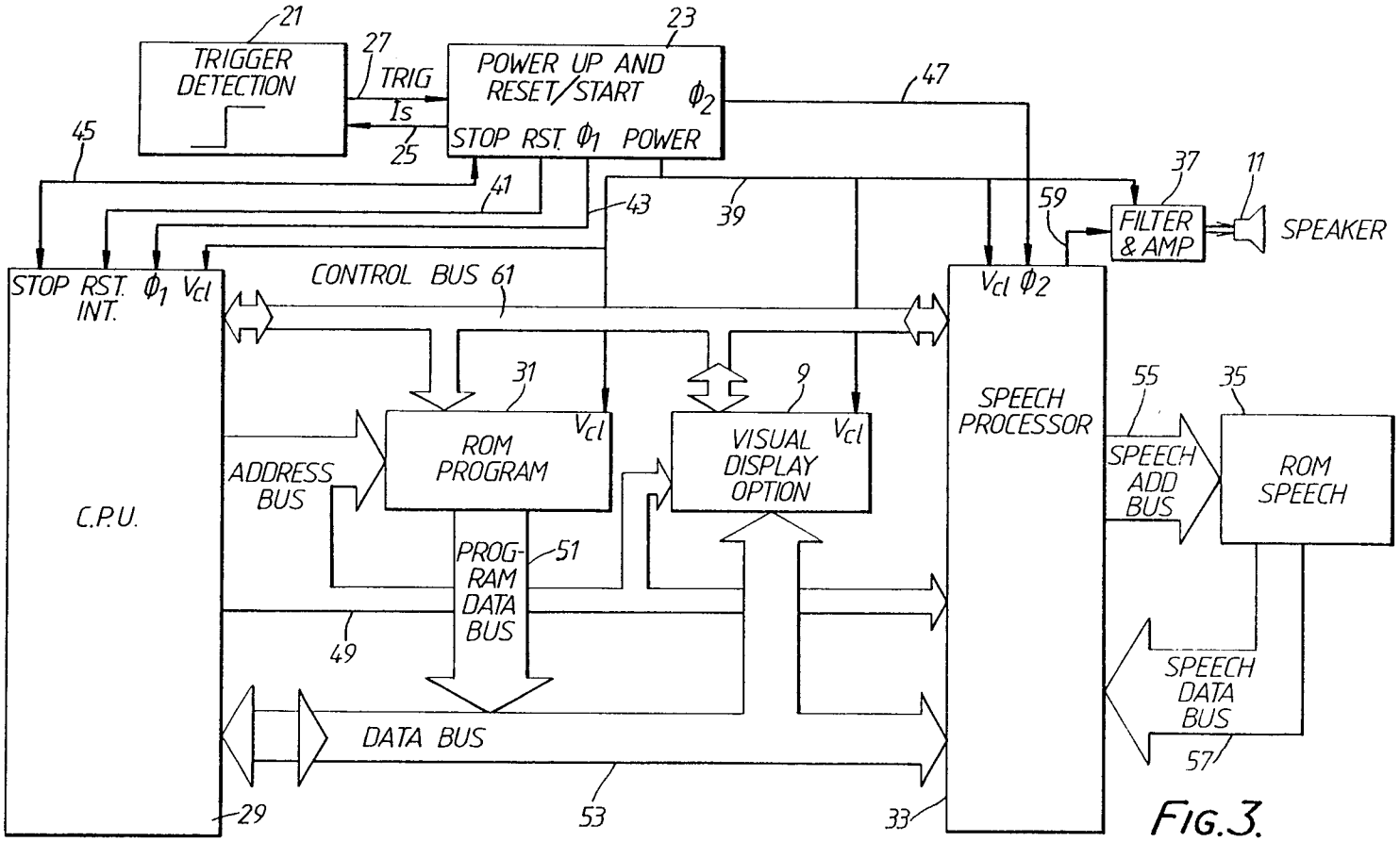
FIG. 3 is a schematic diagram of a control circuit which is incorporated into the removable cap of FIG. 1.

The operation of the electronic circuitry 15 will now be described with reference to FIG. 3.

The trigger device 19 is connected to a switching device 23 which acts to switch on the power from the power source and reset and start the circuitry in response to a trigger signal from the trigger device 19. The switching device 23 is connected to the power source by means not shown. The switching device 23 delivers a standby current $I_s$, which is typically less than 1 microamp, along a line 25 to the trigger device 19 so as to enable the trigger device 19 to be able to deliver a trigger detect signal TRIG. along a return line 27 to the switching device 23. The switching device 23 is connected to a central processing unit 29, which is a micropressor chip such as a Z8 or Z 80 made by Zilog. The central processing unit 29 is associated with a Program ROM 31 which contains the program for operating the chip. There is also provided a speech processor 33 which is a chip such as an MM 54104 supplied by RS Components. The speech processor 33 is associated with a speech ROM 35 which contains the speech data which is to be processed by the speech processor 33 and then to be outputted by the speaker 11 via a filter and amplifier unit 37. The visual display unit 9 is shown schematically in FIG. 3 and may incorporate an appropriate microprocessor chip, if desired. The switching device 23 is connected by a power line 39 to the central processing unit 29, the program ROM 31, the speech processor 33, the visual display unit 9 and the filter and amplifier unit 37. The switching device 23 is also connected by lines 41 and 43 to the central processing unit 29 over which are delivered a reset signal RT. and a first timing signal $\phi_1$, respectively, from the switching device 23 to the central processing unit 29. A further line 45 is provided for the delivery of a stop signal STOP from the central processing unit 29 to the switching device 23. The switching device 23 is further connected to the speech processor 33 via a line 47 for delivery of a second timing signal $\phi_2$ from the central processing unit to the speech processor 33.

In operation, when the trigger device 19 has been activated, the trigger detect signal TRIG. is sent to the switching device 23 which then sends a power up signal VCL. along power line 39 to the central processing unit 29, the program ROM 31, the speech processor 33, the visual display unit 9 and the filter and amplifier unit 37. A reset H RST. signal and a first timing signal $\phi_1$ are sent along lines 41 and L 43 to the central processing unit 29 and a second timing signal $\phi_2$ is sent to the speech processor 33 along line 47. In this way the various circuit components are powered, re-set and clocked.

When it has been activated in this manner, the central processing unit 29 addresses the program ROM 31 via an address bus 49 and the program which is stored in the program ROM 31 is sent to the central processing unit 29 via a program data bus 51 and then a main data bus 53. In this way the central processing unit 29 is loaded with its operating program. The central processing unit 29 then addresses the speech processor 33 via the address bus 49 thereby to activate the speech processor 33 which receives data from the central processing unit 29 via the main data bus 53 concerning the first word to be outputted by the speech processor 33. In response to this, the speech processor 33 addresses the speech ROM 35 via a speech address bus 55 and speech data is outputted therefrom to the speech processor 33 via a speech data bus 57. The speech processor 33 receives the speech data for the first word and then processes this data and outputs a processed signal over a line 59 to the filter and amplifier unit 37. The filter and amplifier unit 37 acts both to amplify the signal which is then sent to the speaker 11 and to filter out undesirable frequencies so as to render the audible synthesised speech output of the speaker 11 as near as possible to human speech.

When the first word has been processed by the speech processor 33 a control signal is sent therefrom along a control bus 61 to the central processing unit 29 which is then activated to again address the speech processor 33 and send data thereto so as to cause the speaker to output the second word in a manner similar to that described above. The control bus acts to clock the operation of the various components of the circuit. This cycle repeats itself until all of the desired words have been outputted by the speaker 11 so that a complete audible message has been spoken by the speech synthesiser.

The visual display unit 9 is also operated together with the speech processor 33 and speaker 11. The visual display unit 9 is addressed by the control processing unit 29 via the address bus 49 and receives operating data therefrom via the main data bus 53. The data of the words to be displayed may be stored either in the program ROM 31 or the central processing unit 29. The visual display unit 9 displays the first word and then activates the central processing unit 29 with a control signal via the control bus 61 to address the visual display unit 9 again so that it can be operated to display the second word. This cycle continues in this manner until the appropriate desired message has been displayed.

The speaker 11 and the visual display unit 9 may be operated either simultaneously or in sequence. When the desired messages have been outputted, the central processing unit 29 is activated by a control signal via the control bus 61 to send a stop signal to the switching device 23. This turns off the power to the control circuit.

If desired, the control unit may be incorporated in a single chip or in a plurality of chips. It is preferable that the circuit takes as little power as possible so as to give a long operating life of the power source and that the power source and the circuitry are miniaturized much as possible for easy incorporation of the assembly in to the cap 3. The visual display unit is preferably a low power LCD circuit. The speech ROM may have any appropriate desired number of words, for example fifty, the number of words which is provided being dependent upon the particular application of the invention. In an alternative arrangement, the central processing unit 29 could be substituted by a presettable counter with a timing control circuit. Furthermore, the power source could be omitted for applications where the bottle is to be connected to an external power source in order to operate the speech synthesiser and visual display unit. In addition, the speech ROM could be a so-called 'phonetic speech ROM' which stores phonetic data and leads to improved reproduction of speech.

The present invention has particular applications for use in conjunction with containers, e.g. bottles, jars, tins, packs, etc., in which it is desired to impart warnings and information to the end user of toxic, chemical and pharmaceutical products. The incorporation of a speech synthesiser into or on the container, preferably in conjunction with visual display unit, permits immediate communication to the end user of important information regarding the product in the container. The speech synthesiser could be activated in response to the user opening the container as described earlier, which enables immediate communication to the user of information in the product.

For example, when the container contains a chemical product (such as an insecticide) or a pharmaceutical product (such as a drug), the speech synthesiser could be activated to issue an audible warning such as "Have you read the instructions?" or give details of the date of manufacture, useful life or size of dosage of the product.

A particularly important application is in providing the end user of an indication that the pack has been tampered with. To achieve this, the device of the invention could incorporate a "double trigger" feature whereby when the container was first opened the device gave no visual or audible output but when the container was subsequently opened it issued an audible/visual warning to the end user such as "Stop. This pack has been tampered with". Alternatively, the device could emit a series of audible bleeps if the container has been tampered with.

In further arrangements, the device could be activated to emit a message upon hearing a spoken password; upon the passage of a period of time (e.g. when drugs are packaged, the container can be arranged to give an audible message every time it is required to take the prescribed dose); upon heat from the hand or upon pressure on the cap.

Furthermore, the device could be arranged so that a locking device, such as an electronic locking device, is incorporated into circuitry so that the cap could be removed only by unlocking the cap, by employing a password or some information contained in the printed instructions associated with the pack.

The illustrated plastics bottle cap has a particular advantage in that it can incorporate the device of the present invention without substantially altering its external configuration and dimensions so that it could be handled and applied to the container using conventional packaging processes and equipment.

A particular application for the present invention is in the packaging of insecticides. The bottle containing the insecticide is inserted into a sprayer which dilutes the insecticide with water to the appropriate amount and then sprays the dilute solution. The cap could be adapted to be insertable into a power supply device on or associated with the sprayer which provides the power for running the electronic circuitry in the cap. The user could then hear and see the relevant information stored in the cap before using the insecticide.

What I claim is:

1. A container for a product having a removable closure, the container having means for electronically generating an audible signal disposed in said removable closure, said signal relating to the product in the container, said means being activated by a user, whereby said means for electronically generating an audible signal includes a trigger device which triggers said means into operation in response to removal of the closure from the container.

2. A container for a product having a removable closure, the container having means for electronically generating an audible signal only after a first removal of the closure from the container, said means for generating an audible signal being disposed in said removable closure, said signal relating to the product in the container, said means being activated by a user whereby said means for electronically generating an audible signal includes a trigger device which triggers said means into operation in response to a second or subsequent removal of the closure from the container.

3. A container according to claims 1 or 2 wherein the said means for electronically generating an audible signal include a speech synthesiser.

4. A container according to claim 3, wherein the speech synthesiser processing unit and outputs signals representing words to a speaker which emits recognisable words.

5. A container according to claim 4, wherein the means for generating an audible signal are disposed in a removable closure for the container.

6. A container according to claim 5, wherein the container is a bottle, the removable closure is a threaded cap for the bottle, and the threaded cap includes a top wall which acts as a diaphragm for the speaker.

7. A container according to claim 1, wherein the container is a bottle and the removable closure is a threaded cap for the bottle.

* * * * *